US006231088B1

(12) United States Patent
Balthazard et al.

(10) Patent No.: US 6,231,088 B1
(45) Date of Patent: May 15, 2001

(54) HEAT EXCHANGER HEADER BOX CONNECTOR AND METHOD OF FIXING SAME

(75) Inventors: Patrick Balthazard, Guignicourt; Philippe Faille, Reims, both of (FR)

(73) Assignee: Valeo Thermique Moteur (FR)

( * ) Notice: Subject to any disclaimer, the term of this patent is extended or adjusted under 35 U.S.C. 154(b) by 0 days.

(21) Appl. No.: 09/269,662

(22) PCT Filed: Jul. 22, 1998

(86) PCT No.: PCT/FR98/01621

§ 371 Date: Mar. 30, 1999

§ 102(e) Date: Mar. 30, 1999

(87) PCT Pub. No.: WO99/06783

PCT Pub. Date: Feb. 11, 1999

(30) Foreign Application Priority Data

Jul. 30, 1997 (FR) ..... 97 09729

(51) Int. Cl.[7] ..... F16L 41/00

(52) U.S. Cl. ..... 285/209; 285/189; 285/208

(58) Field of Search ..... 285/208–210, 285/197, 189

(56) References Cited

U.S. PATENT DOCUMENTS

| | | | | |
|---|---|---|---|---|
| 377,506 | * | 2/1888 | Whiter | 285/209 |
| 1,049,283 | * | 12/1912 | Westphal | 285/209 |
| 1,913,222 | * | 6/1933 | Von Glahn | 285/210 |
| 2,241,293 | * | 5/1941 | Campbell | 285/208 X |
| 3,138,660 | * | 6/1964 | Cejka | 285/209 X |
| 3,716,257 | | 2/1973 | Hackman et al. . | |
| 5,101,887 | | 4/1992 | Kado . | |

FOREIGN PATENT DOCUMENTS

| | | | | |
|---|---|---|---|---|
| 484 577 | | 10/1929 | (DE) . | |
| 2134169 | * | 1/1973 | (DE) | 285/208 |
| 0 255 313 | | 2/1988 | (EP) . | |
| 1682710 | * | 10/1991 | (SU) | 285/209 |

* cited by examiner

*Primary Examiner*—Teri Pham Luu
(74) *Attorney, Agent, or Firm*—Morgan & Finnegan, LLP

(57) ABSTRACT

The invention concerns the field of heat exchanger header boxes, in particular in motor vehicle ventilation, heating and/or air conditioning installations. It is more particularly concerned with a connector adapted to be introduced into a header box. To prevent the connector becoming separated from the header box before the assembly is brazed together, the connector in accordance with the inventor includes a lug adapted to prevent movement in translation of the connector towards the outside of the header box.

17 Claims, 2 Drawing Sheets

HEAT EXCHANGER HEADER BOX CONNECTOR AND METHOD OF FIXING SAME

BACKGROUND OF THE INVENTION

The invention concerns a pipe connector, in particular of a motor vehicle ventilation, heating and/or air conditioning installation. It is intended in particular to be inserted into a substantially annular opening of a header box of a heat exchanger of that installation.

BRIEF SUMMARY OF THE INVENTION

A connector of the above type is usually of substantially cylindrical shape adapted to be inserted into an annular opening in the header box. The connector is then brazed into the box to stiffen the assembly in a high temperature furnace.

The assembly is usually transported towards the furnace—generally on a conveyor belt—between the steps of inserting the connector into the header box and brazing. In the context of mass production on automated assembly lines, this type of transport can cause vibration. Disadvantageously, the known connectors fall out of the header box when they are subject to excessive impact and/or vibration during transport.

An aim of the invention is to overcome this drawback.

To this end it proposed to provide connectors of the above-mentioned type with a lug projecting from one of their outside lateral walls. Once introduced into the header box, the lug forms an abutment to prevent longitudinal movement of the connector towards the outside of the header box.

According to one feature of the invention the lug of the connector is substantially pyramid-shaped. One wall of the pyramid is, plane substantially in a plane perpendicular to the axis of the connector and adjacent a top wall of the connector. The outside width of the connector plus the height of the lug along its plane wall is advantageously greater than the width of the opening in the header box. Thus the connector cannot escape from the header box after it is introduced into it.

In accordance with another advantageous feature of the invention its top wall is substantially in an inclined plane at a chosen angle to a plane perpendicular to the axis of the connector. This angle is chosen so that the connector can enter the header box by pivoting about a point inside the header box and on which the lug bears.

Accordingly the lug and the connector can be slid into the header box in accordance with a method for fixing the connector to the header box that is also provided by the present invention.

BRIEF DESCRIPTION OF DRAWINGS

Other features and advantages of the invention will become apparent on examining the following detailed description and the accompanying drawings, in which.

DETAILED DESCRIPTION OF DRAWINGS

The drawings essentially contain elements of a definite character. They can therefore serve not only to explain the invention but can also contribute to defining the invention, if necessary.

An embodiment of connector 1 of a pipe 2 adapted to convey a refrigerant fluid will be described first with reference to FIG. 1. The connector 1 is adapted to be introduced into the header box 3 of a cooling radiator (not shown) of a motor vehicle ventilation, heating and/or air conditioning installation. The header box 3 is substantially in the form of a hollow cylinder and has a substantially circular opening 9 through which the connector 1 is introduced.

Figure 2:
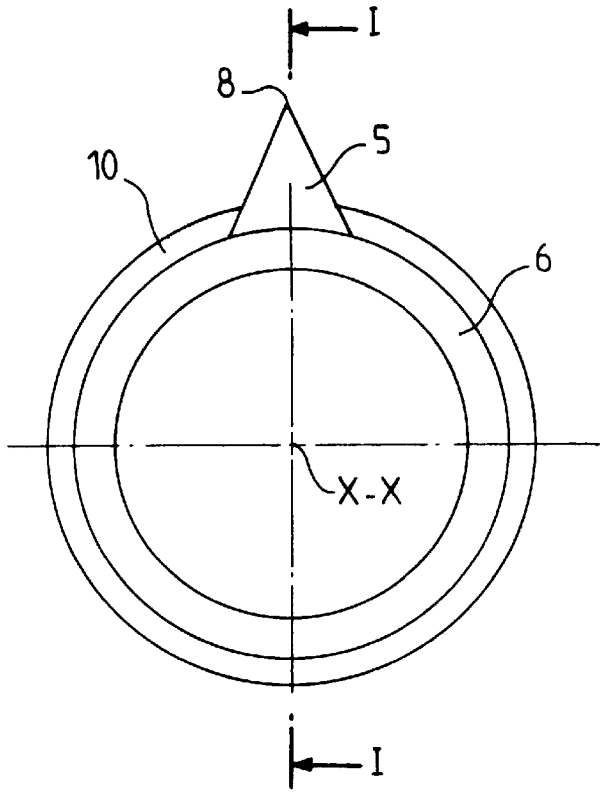
FIG. 2 is a front view of the connector in accordance with the invention.

The connector 1 in accordance with the invention includes a lug 4 which in the embodiment shown is substantially pyramid-shaped on a triangular base. The axis XX of the connector 1 and the top edge 7 of the pyramid are coplanar and define a predetermained angle $\alpha$ (FIG. 3*b*). One plane face 5 of the pyramid is adjacent the top wall 6 of the connector 1. The plane wall 5 is substantially perpendicular to the connector axis XX. As shown in FIG. 2, the lug 4 is substantially V-shape with an angle of approximately 45° between the branches.

In the embodiment shown the connector 1 is substantially circular in section. The opening 9 in the header box 3 is of substantially analogous shape but has a diameter slightly greater than the section of the connector 1.

Figure 1:
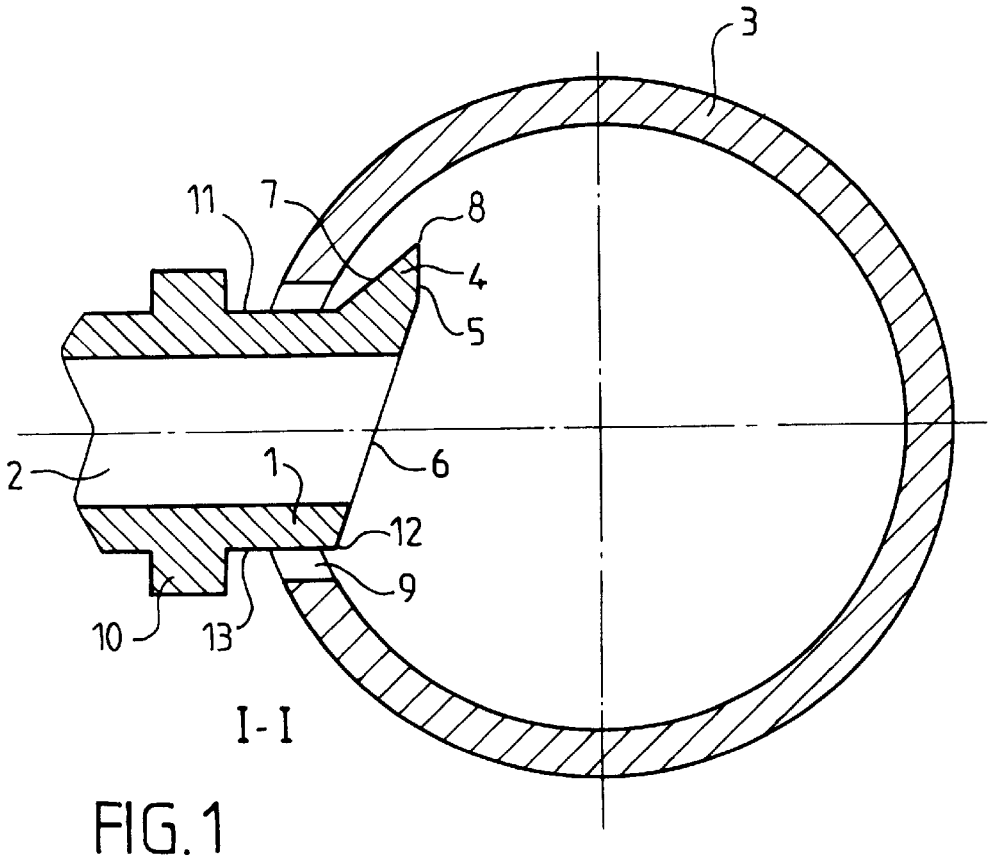
FIG. 1 is a view in cross-section taken along the line I—I of a combination comprising a connector in accordance with the invention and the header box of a heat exchanger.

The connector 1 has a substantially circular indentation 10 which is the shape of a crenellation when seen in cross-section taken along the line I—I (see FIG. 1). The indentation 10 projects from the outside lateral wall 11 of the connector and forms an abutment to prevent additional movement of the connector 1 in translation towards the header box 3.

The top wall 6 of the connector is advantageously substantially in an inclined plane at an acute angle to the side wall 11 from which the lug projects.

Figure 3A:
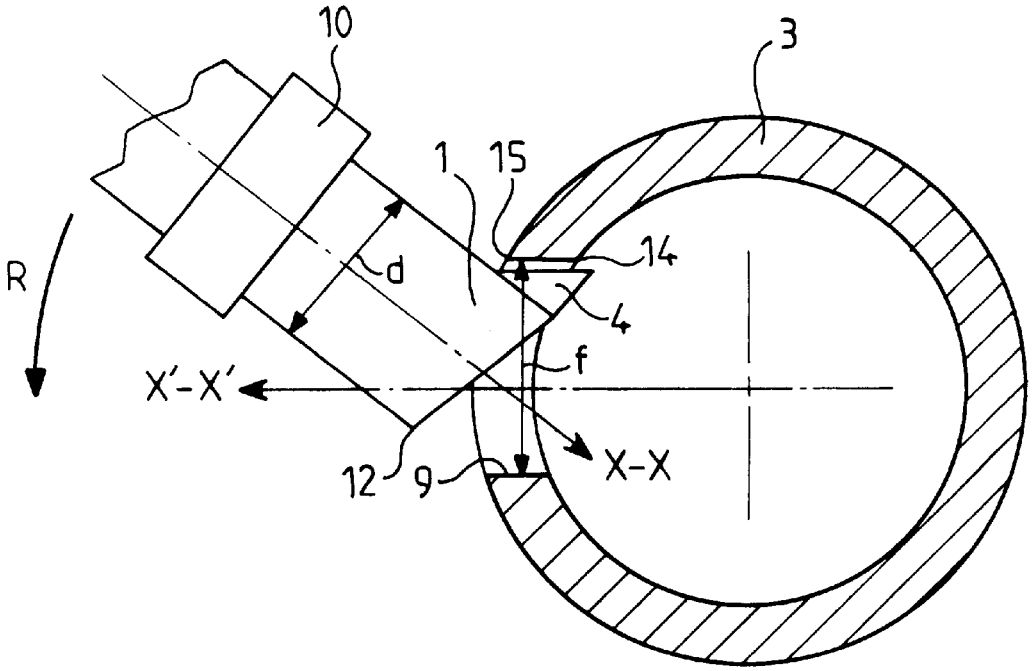
FIG. 3*a* is a diagram showing the connector in accordance with the invention before it is introduced into the header box.
Figure 3B:
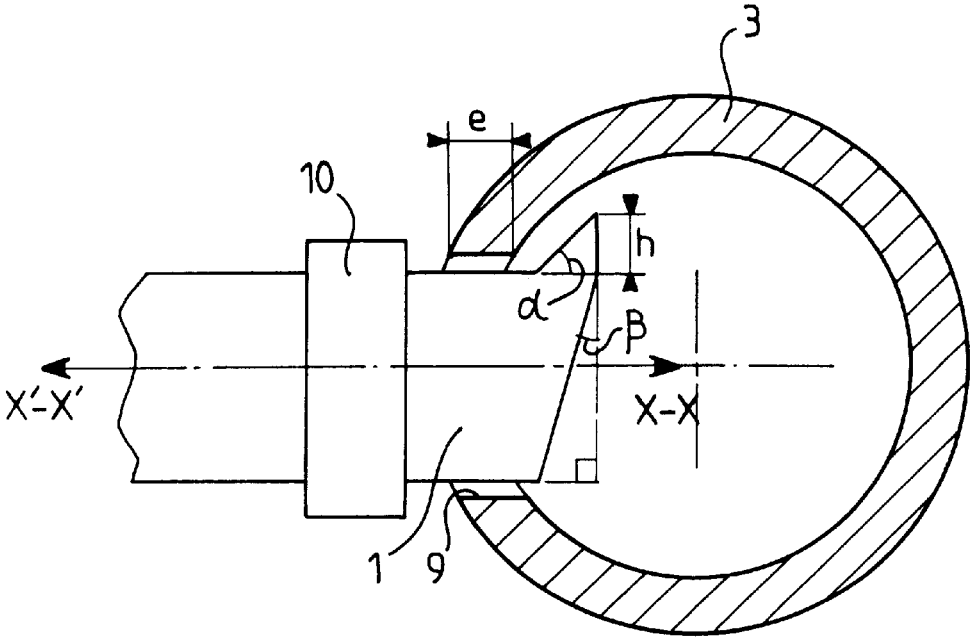
FIG. 3*b* is a diagram showing the connector in accordance with the invention after it has been introduced into the header box.

Accordingly the connector 1 of the invention can be fixed to the header box 3 by a method comprising the following steps:

- offering the lug 4 on the connector 1 up to the opening 9 in the header box 3; as shown in FIG. 3*a*, the connector 1 is then slightly inclined with the top edge of the lug 4 substantially parallel to the axis X'X' of the opening 9,
- introducing the connector 1 into the box 3 by movement in translation parallel to the axis X'X' of the opening,
- imparting rotation R to the connector 1 so that the axis XX of the connector is substantially coincident with the axis X'X' of the opening, as shown in FIG. 3*b*; the assembly formed by the connector 1 and the header box 3 can then be transported for a final brazing step,
- finally, rendering the assembly rigid by brazing it in a high-temperature furnace.

It remains to define a few relations between the dimensions of the lug 4, those of the connector 1 and, obviously, those of the opening 9 in the header box 3.

First of all, so that the connector 1 cannot escape from the header box 3 before the brazing step, the width f (FIG. 3*a*) of the opening 9 in the header box 3 must satisfy the following condition:

$$f<d+h \quad (1)$$

where d is the width of the connector 1 (FIG. 3*a*) and h is the height of the lug 4 (FIG. 3*b*). This situation is shown in FIG. 3*b*.

Clearly, in this case, the rotation R of the connector 1 so that it can be introduced into the box 3 is about the point 14 (FIG. 3*a*) where the inside periphery of the box 3 intersects the opening 9. The lug 4 bears on this point 14 in order for the lug to pivot as shown in FIG. 3*a*. During this pivoting the outside lateral wall 11 of the connector 1 remains abutted against the point 15 on the header box 3 where its opening 9 and its outside periphery intersect.

For the connector 1 then to be able to enter the box 3 the distance between the point 14 on the box 3 and the point 12 on the connector 1, where its top wall 6 intersects its outside lateral wall 13 opposite the lug 4, must be smaller than the width of the opening 9. Using the following notation (FIGS. 3*a* and 3*b*):

- $\alpha$ is the angle between the top edge 7 of the lug 4 and the outside lateral wall 11 of the connector 1,
- $\beta$ is the angle between the top wall 6 of the connector 1 and the plane perpendicular to the axis XX of the connector, and
- is the thickness of the shell of the header box 3, then the distance L between the point 12 on the connector and the point 14 on the box is given by:

$$L^2=(e\cos\alpha-h/\tan\alpha+d\tan\beta)^2+(e\sin\alpha+d)^2 \quad (2)$$

A compromise is therefore imposed as to the opening 9 in the header box 3. Its width f (FIG. 3*a*) must satisfy the following condition:

$$L<f<d+h \quad (3)$$

To minimize the distance L a relation must be established between the angles $\alpha$ and $\beta$. Neglecting the thickness e of the shell of the header box 3 in equation (2), this relation is written:

$$D\tan\beta-h/\tan\alpha=0$$

$\beta$ is given by:

$$\tan\beta=(h/d)\ (1/\tan\alpha)$$

The product of the tangents of the angles $\alpha$ and $\beta$ is therefore substantially equivalent to the ratio of the height h of the lug 4 to the external width d of the connector 1, which is geometrically equivalent to having the straight line through the points 12 and 14 perpendicular to the axis XX of the connector 1.

Given the above conditions, it is sufficient for the opening 9 in the header box 3 to have a width f greater than the outside width d of the connector 1 for the connector to be able to enter the box.

Note that if the thickness e of the shell is negligible compared to the outside section d of the connector 1 and to the height h of the lug 4, the point 14 and the point 15 become practically coincident at the intersection between the top edge 7 of the lug and the adjacent outside lateral wall 11.

Of course, the invention is not limited to the embodiment described previously by way of example and encompasses other variants.

Accordingly, it will be realized that the general shape of the lug 4 can be different. It can be quarter-sphere shape, for example, with a plane face adjacent the top wall 6 of the connector.

Also, the section of the connector and the opening 9 in the header box are not necessarily circular. They can be substantially rectangular, for example.

Finally, the connector and the method of fixing the connector in accordance with the invention are not limited to an application in a ventilating, heating and/or installation.

What is claimed is:

1. A pipe for a motor vehicle ventilation and/or air conditioning installation having a header box with an opening defining a longitudinal axis, the pipe comprising:

a substantially cylindrical body having an outer surface, an inner surface, and an annular top surface, the body adapted to be introduced into the opening of the header box in a fitting direction along the longitudinal axis of the opening; and a lug having an at least one planar surface projecting from the outer surface of the body, the lug configured to form an abutment to prevent longitudinal movement of the pipe in a direction opposite the fitting direction when the body is introduced into the opening, and wherein the annular top surface of the body is substantially planar and defines a plane that is inclined at a predetermined angle $\beta$ with respect to the planar surface of the lug.

2. The pipe of claim 1, wherein the planar surface extends a predetermined distance (h) from the annular top surface of the body in a direction that is substantially perpendicular to a longitudinal axis of the body.

3. The pipe of claim 2, wherein the body defines an outer diameter (d), and a sum of the outer diameter (d) of the body and the distance (h) of the planar surface of the lug is greater than a width (f) of the opening of the header box.

4. The pipe of claim 1, wherein the lug is substantially pyramid-shaped and comprises:

a triangular base with three legs and qarried on the outer surface of the cylindrical body; and at least three surfaces extending from the legs of base and converging a point.

5. The pipe of claim 4, wherein a one of the at least three surfaces is a substantially planar surface extending from the outer surface of the substantially cylindrical body and defining a predetermined angle $\alpha$ with respect to a longitudinal axis of the body.

6. The pipe of claim 5, wherein a second of the at least three surfaces is said at least one planar surface and extends a predetermined distance (h) from the annular top surface of the body in a direction that is substantially perpendicular to the longitudinal axis of the body.

7. The pipe of claim 6, wherein the product of the tangents of the first angle $\alpha$ and the second angle $\beta$ is substantially equal to the ratio of the distance (h) of the lug to an outside diameter (d) of the pipe.

8. The pipe of claim 1, wherein an outside diameter (d) of the pipe is less than a width (f) of the opening of the header box.

9. The pipe of claim 1, wherein the lug comprises a v-shaped body having at least two surfaces extending from outer surface of the substantially cylindrical body, the at least two surfaces defining an angle of approximately 45°.

10. The pipe of claim 1, further comprising a crenellated projection carried on the outer surface of the substantially cylindrical body, the projection being adapted to form an abutment to prevent additional movement in the fitting direction when the body is introduced into the opening.

11. The pipe of claim 1, wherein the substantially cylindrical shaped body is adapted to convey a refrigerant fluid from the header box.

12. A device comprising:

a conduit adapted to be introduced into an opening of a motor vehicle header box, the conduit including a substantially annular top surface; and a lug projecting from an outer surface of the conduit, the lug configured to prevent withdrawal of the conduit from the opening along a longitudinal axis of the opening when a conduit axis is substantially aligned with the longitudinal axis wherein the top surface of the conduit is tapered and defines an angle $\beta$ with an axis substantially perpendicular to the conduit axis.

13. The device of claim 12, wherein the lug is a substantially pyramid-shaped body and comprises:

a triangular base carried on the outer surface of the conduit; and at least three substantially planar surfaces extending from the base and converging at a point a distance (h) from the outer surface of the conduit.

14. The device of claim 13, wherein a one of the said three substantially planar surfaces extends from the top surface of the conduit in a direction that is substantially perpendicular to the conduit axis.

15. The device of claim 14, wherein a second and a third of the substantially planar surfaces define an angle of 45° therebetween.

16. The device of claim 15, wherein the second and the third of the substantially planar surfaces converge to form a line, and wherein the line and the outer surface of the conduit define a predetermined angle $\alpha$ therebetween.

17. The device of claim 16, wherein an outside diameter (d) of the conduit is substantially equal to the distance (h) divided by a product of the tangents of the angle $\alpha$ and the angle $\beta$.

* * * * *